United States Patent [19]

Mizuno et al.

[11] Patent Number: 4,475,589

[45] Date of Patent: Oct. 9, 1984

[54] HEAT EXCHANGER DEVICE

[75] Inventors: Saburo Mizuno, Nagoya; Yutaka Kozawa, Inazawa; Tosikazu Ogata, Aichi, all of Japan

[73] Assignee: Tokyo Shibaura Denki Kabushiki Kaisha, Japan

[21] Appl. No.: 302,350

[22] Filed: Sep. 15, 1981

[30] Foreign Application Priority Data

Jan. 21, 1981 [JP] Japan ..... 56-8291
Jan. 22, 1981 [JP] Japan ..... 56-8193

[51] Int. Cl.[3] ..... F28F 3/08
[52] U.S. Cl. ..... 165/166
[58] Field of Search ..... 165/166, 167

[56] References Cited

U.S. PATENT DOCUMENTS

| | | | |
|---|---|---|---|
| 2,288,061 | 5/1942 | Arnold | 165/166 |
| 2,361,691 | 10/1944 | Vendrassik | 165/166 |
| 3,590,917 | 7/1971 | Huber et al. | 165/168 |
| 3,666,007 | 5/1972 | Yoshino et al. | 165/166 |
| 4,146,090 | 3/1979 | Nakayama et al. | 165/167 |

FOREIGN PATENT DOCUMENTS

| | | | |
|---|---|---|---|
| 38-8447 | 6/1963 | Japan . | |
| 47-19990 | 6/1972 | Japan . | |
| 54-2686 | 2/1979 | Japan . | |
| 304183 | 1/1930 | United Kingdom . | |
| 618606 | 2/1949 | United Kingdom . | |
| 1024977 | 4/1966 | United Kingdom | 165/167 |
| 1354502 | 5/1974 | United Kingdom . | |
| 1433379 | 4/1976 | United Kingdom . | |
| 1561981 | 3/1980 | United Kingdom . | |
| 2047313 | 11/1980 | United Kingdom . | |
| 1595511 | 8/1981 | United Kingdom . | |
| 2091407 | 7/1982 | United Kingdom | 165/166 |

*Primary Examiner*—Sheldon J. Richter
*Attorney, Agent, or Firm*—Finnegan, Henderson, Farabow, Garrett & Dunner

[57] ABSTRACT

A heat exchanger device including a core having a stack of parallel heat-conductive plates which are formed with corrugations for channeling air between the plates, each plate being fabricated from a single sheet. The corrugations of successive plates are offset from each other for providing both separation and support of the plates with respect to each other. The heat exchanger is the combination of the core and a ventilation unit in a single housing for ventilating primary and secondary air through respectively alternating pairs of successive plates.

5 Claims, 26 Drawing Figures

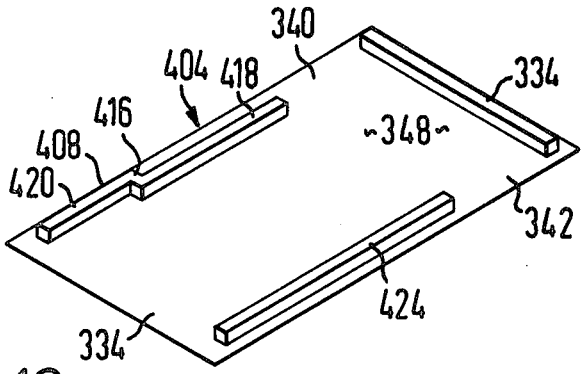
FIG. 13
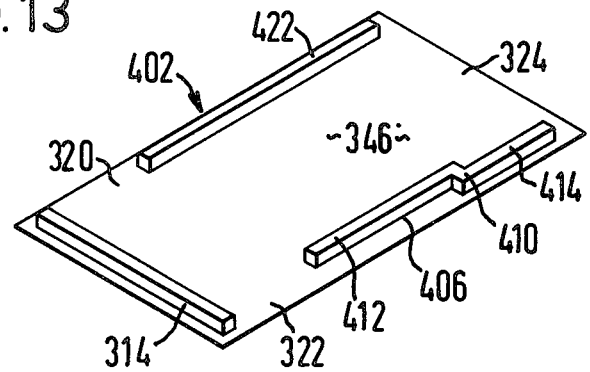
FIG. 14
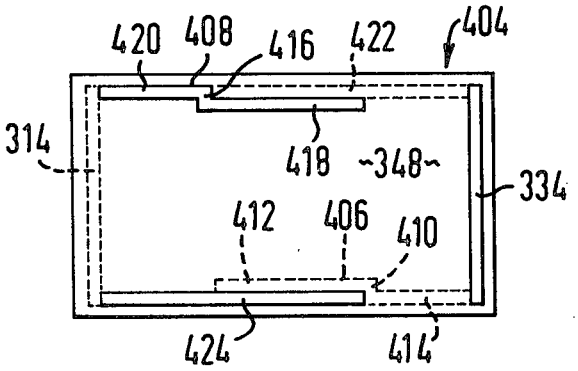

HEAT EXCHANGER DEVICE

BACKGROUND OF THE INVENTION

This invention relates to heat exchanger devices, and more particularly to a device for providing exchange of heat between two air streams.

In a prior art heat exchanger, as shown in U.S. Pat. No. 3,666,007, heat exchanging plates and laminated spacers are alternately stacked. The laminated spacers are used for channeling air flow between the heat exchanging plates. However, the laminated spacers do not contribute to the exchange of heat and many elements are required for the heat exchanging plates and the laminated spacers to compose the heat exchanger. Many steps for the manufacturing process are therefore needed and the manufacturing cost of the heat exchanger becomes high.

SUMMARY OF THE INVENTION

It is therefore, an object of this invention to simplify and, thereby, to reduce the manufacturing costs of heat exchanger devices.

It is a more specific object of this invention to make the channeling spaces of heat exchanging devices contribute to the exchange of heat.

It is another object of this invention to provide a small type heat exchanger in combination with an air ventilation unit.

According to this invention, a heat exchanger comprises a core including a stack of parallel plates, each of the plates being formed from a single heat-conductive sheet, each plate having corrugations formed therein for channeling fluid between successive pairs of the plates, the corrugations of pairs of successive plates being relatively offset to provide separation and support for the plates by the contacts of the corrugations of each sheet with at least one plate immediately above or below.

BRIEF DESCRIPTION OF THE DRAWINGS

FIG. 13 is an exploded, perspective view of a fourth embodiment of the plates of the core according to this invention;

FIG. 14 is a top plan view of stacked plates as shown in FIG. 13;

DESCRIPTION OF THE PREFERRED EMBODIMENTS

Figure 1:
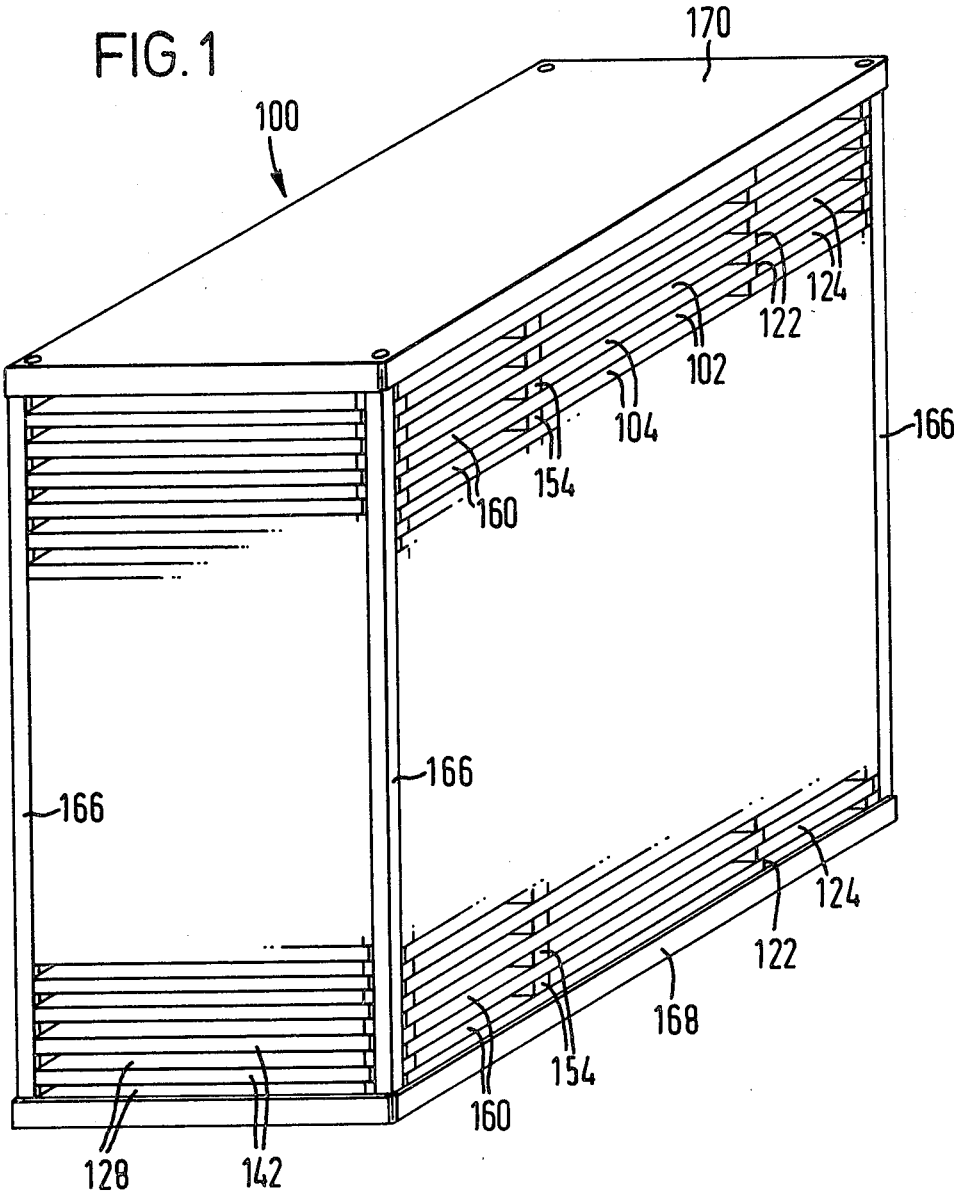
FIG. 1 is a perspective view of a core for a heat exchanger according to this invention.

Referring to FIG. 1, a core 100 for a heat exchanger device is composed of stacked alternating first plates 102 and second plates 104. Each of plates 102, 104 is formed from a single heat-conductive sheet. The plates 102 and 104 are formed with individual corrugations as shown in FIG. 2.

Figure 2:
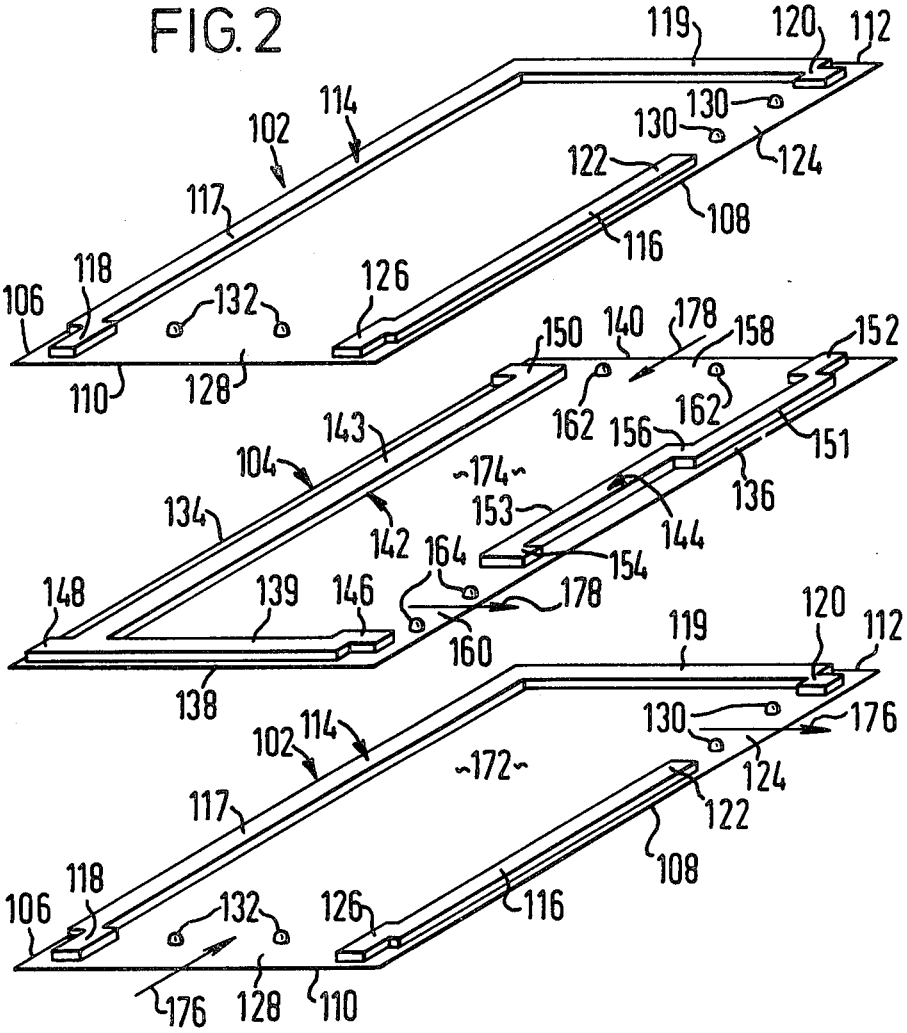
FIG. 2 is an exploded, perspective view of one embodiment of plates for the core of FIG. 1.
Figure 4:
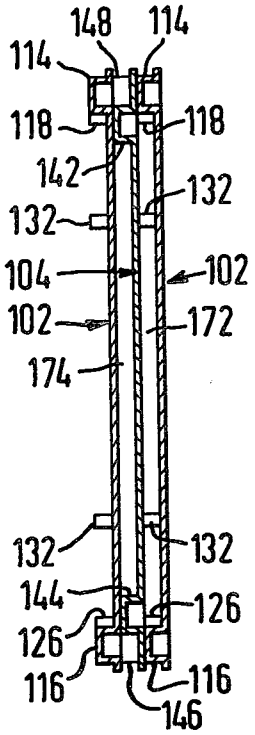
FIG. 4 is a cross-sectional view of the stacked plates taken along the line 4—4 of FIG. 3.

Referring to FIG. 2, the first plate 102 is rectangular and may have long sides 106, 108 and short sides 110, 112. The first plate 102 is formed with a substantially L-shaped corrugation 114 and another corrugation 116 for directing air flow, for supporting a plate above and for separating a pair of successive plates. The corrugations 114 and 116 form ridges on one side of plate 102 and grooves on the opposite side of the plate.

The L-shaped corrugation 114 has a long leg 117 adjoining a long side 106 and a short leg 119 adjoining a short side 112. The ends of the corrugation 114 have offset portions 118 and 120 on the long leg 117 and short leg 119. The other corrugation 116, of like height to the corrugation 114, adjoins the other long side 108. The end portion 122 of the corrugation 116 is opposite the offset portion 120 of the short leg 119 for opening an air outlet 124. The other end of the corrugation 116 is formed with an offset portion 126. The offset portion 126 is opposite the offset portion 118 of the end of the long leg 117 for opening an air inlet 128. Bosses 130 and 132 of the same height as the corrugations 114, 116 are formed in the plate 102. The bosses 130 are positioned at the air outlet 124 and the bosses 132 are positioned at the air inlet 128.

The second plate 104 is also rectangular and generally resembles the first plate 102, having long sides 134, 136 and short sides 138, 140. The plate 104 is also formed with a substantially L-shaped corrugation 142 and another corrugation 144, the long leg 143 of the L-shaped corrugation 142 adjoining a long side 134 and the short leg 139 of corrugation 142 adjoining a short side 138.

The long legs 117, 143 of the L-shaped corrugations 114, 142 adjoining the long sides 106, 134 of the plates 102, 104 lie on the corresponding sides of the plates, but the short legs 119, 139 lie on opposite ends of the plates. The long leg 143 of the corrugation 142 is positioned inwardly from the side 134 a sufficient space to be offset from the long legs 117 of the corrugations 114 of the plates 102 above and below. As a result of the offset space, the end portion 150 of the long leg 143 is turned outwardly to terminate substantially at the long side 134, and a short corrugation 148, integral with the corrugation 142, bridges the offset space between the intersection of the legs 143 and 139 and the long side 134.

The other corrugation 144 of plate 104 may be inverse S-shaped. The inverse S-shaped corrugation has a first arm portion 151 adjoining the long side 136 substantially aligned with the openings 124 of the plates 102 above and below, and a second arm portion 153 joined to the first arm portion by a middle portion 156 and spaced from the long side 136. Tne second arm portion 153 is thus offset from the corrugations 116 of the plates 102 above and below for separating and supporting the pairs of plates. The arm portion 151 terminates in an offset end portion 152 and the arm portion 153 has an end portion 154 turned outwardly substantially to the long side 136. None of the terminal portions of the corrugations are complementary, thus providing separation and support of the pairs of successive plates.

There is an opening for an air inlet 158 between the terminal portions 150 and 152. Likewise, an opening for an air outlet 160 is provided between the terminal portions 146 and 154. Bosses 162 and 164, formed in the plate 104, are positioned respectively, in the air inlet 158 and in the air outlet 160.

There are a plurality of series of passageways for air flow through the core 100. The plates are separated from successive plates above and below by the corrugations forming the passageways.

The plates 102 and 104 are made from heat-conductive sheets, for example, plastic sheets, and preferably are formed in vacuum.

Referring again to FIG. 1, the first and second plates 102 and 104 are stacked alternately. Rods 166 are provided attached at each of the four corners of bottom plate 168. The corners of plates 102 and 104 are secured by the rods 166 and the plates are stacked alternately on the bottom plate 168. An upper plate 170 is secured to the upper ends of the four rods 166.

Referring to FIGS. 1–5, a plate 102 is stacked on the bottom plate 168 and a second plate 104 is stacked on the first plate 102. The back of the plate 104 is in contact with the ridges of the corrugations 114 and 116 air tightly. Accordingly the air inlet 128 and the air outlet 124 between the plates 102 and 104, provide a primary air passageway 172 on the plate 102.

Thereafter, a first plate 102 is stacked on the second plate 104. The back surface of the plate 102 is in contact with the ridges of the corrugations 143 and 144 of the plate 104 air tightly. The air inlet 158 and the air outlet 160 provide a secondary air passageway 174 on the second plate 104.

The tops of the bosses 130, 132 and 162, 164 are in contact with the backs of the plates 104 and 102, respectively, holding the respective plates in planar aligned condition at the openings.

Figure 3:
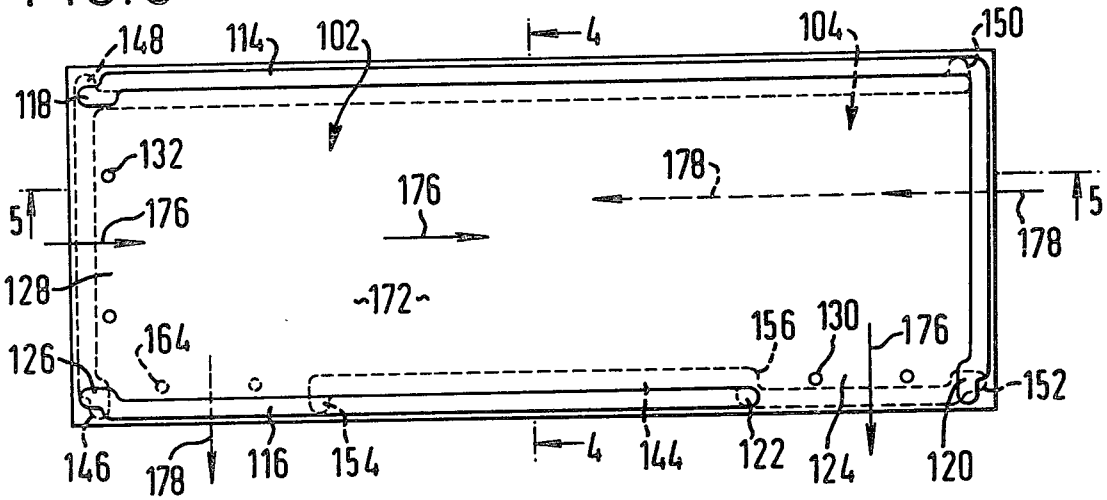
FIG. 3 is a top plan view of stacked plates as shown in FIG. 2.
Figure 5:
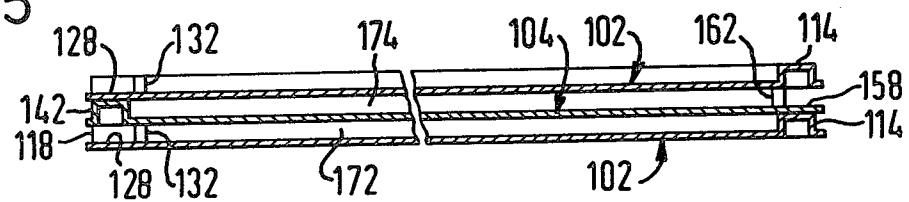
FIG. 5 is a cross-sectional view of the stacked plates taken along the line 5—5 of FIG. 3.
Figure 7:
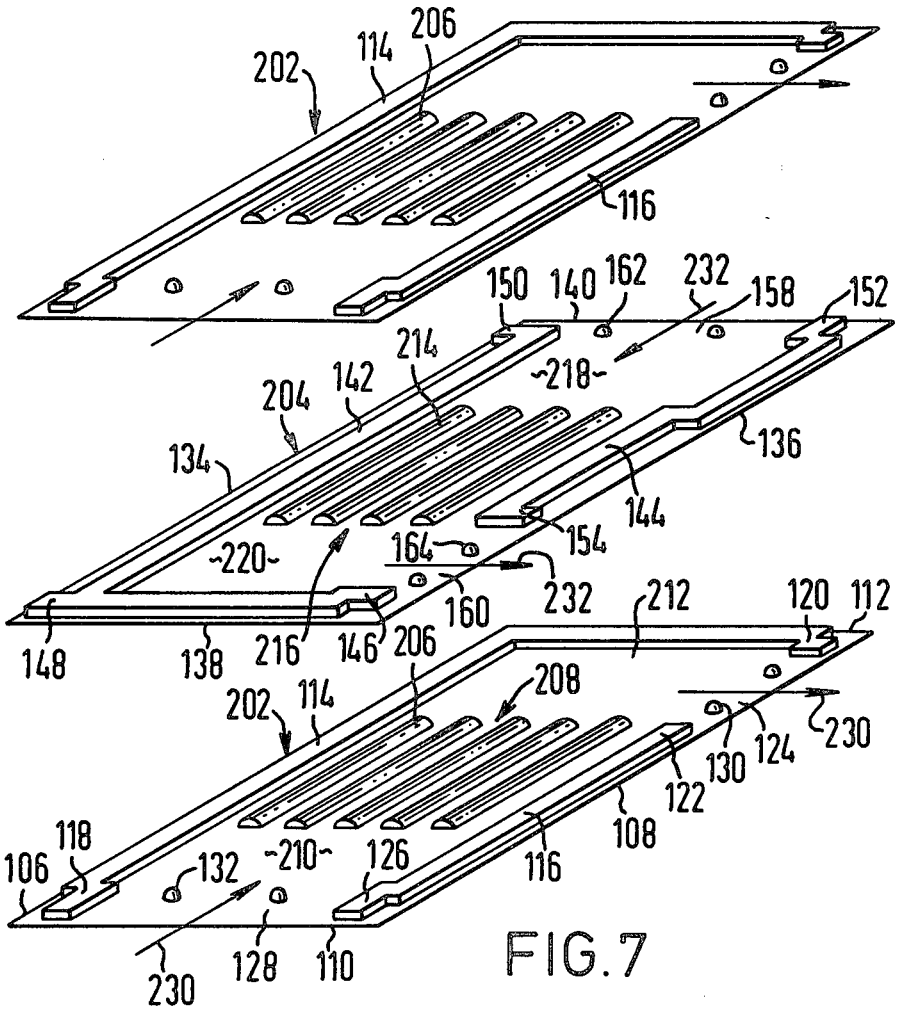
FIG. 7 is an exploded, perspective view of a second embodiment of the plates of the core according to this invention.

Referring to FIG. 3, a second plate 104 is stacked between two first plates 102. The terminations of the portions 146, 148, 150, 152 and 154, of the second plate 104 cross the grooves of the terminal portions 118, 120 and 122, 126 of the first plate 102. These intersections provide separation and support of successive pairs of plates both when a plate 104 is stacked on a plate 102 and when a plate 102 is stacked on a plate 104.

Figure 6:
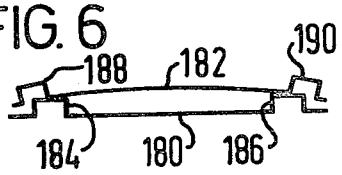
FIG. 6 is a cross-sectional view of a pair of successive corrugated stacked plates for explaining deformation of plates avoided by the invention.

FIG. 6 shows a pair of successive stacked corrugated plates having deformations avoided by the invention. Plates 180 and 182 have corrugations 184, 186 and 188, 190, and these two plates are stacked. The corrugations, however, are not formed with the off-set portions of the invention as described above. The corrugations are offset from each other, but the stack of plates presses the corrugations 188 and 190 adjoining the edges of plate 182 downwardly along the corrugations 184 and 186 offset inwardly from the corrugations 188 and 190. Consequently, the plate 182 is deformed like a bow. In that case, the deformation of the plate 182 causes air leakage between the back of the plate 182 and the ridges of the corrugations 184 and 186.

However, the corrugations of the plates 102 and 104, according to this invention, have the aforementioned offset portions. The offset portions intersect, i.e., cross, each other so that the deformation of the plate 182, as shown in FIG. 6, and the consequent air leakage are avoided.

As shown in FIGS. 1 and 2, the core 100, composed of the stacked plates, has the primary air inlets 128 and the secondary air inlets 158 on opposite short sides 110 and 112, and has the primary air outlets 124 and the secondary air outlets 160 on the corresponding long sides 108 and 136. The two outlets 124 and 160 are thus provided at opposite ends of the same side.

As shown in FIGS. 2 and 3, the primary air 176 flows into an inlet 128, through the passageway 172, and out from the outlet 124. The secondary air 178 flows into the inlet 158, through the passageway 174, and out from the outlet 160.

The passage flows of the primary air 176 and the secondary air 178 are thus in opposite directions through the passageways 172 and 174. The heat exchange between the primary air 176 and the secondary air 178 is made by conduction through the plates 102 and 104.

The corrugations 114, 116 and 142, 144 formed in the plates 102 and 104 are not only spacers for maintaining the primary and secondary air passageways 172 and 174, but are shields for preventing the air from leaking out through the side of the core 100. Accordingly, in this invention, it is not required that the plates are bonded with other spacers as in prior art heat exchanger. The core according to this invention, therefore, has less parts than the prior art heat exchanger and the manufacturing cost can be reduced.

FIGS. 7–10 show a second embodiment of the plates of the core according to this invention. A core 200 has many stacked first and second plates 202 and 204, having the same corrugations as plates 102 and 104 shown in FIG. 2 and bearing the same reference numerals.

However, the first plate 202 has parallel corrugations 206 running longitudinally between the corrugations 114 and 116 and centrally located between the ends of the plate. The corrugations 206 form ridges on one side and grooves on the opposite side of the plate 202, the ends of the corrugations 206 being closed. The corrugations 206 channel air flow between an air inlet area 210 and an air outlet area 212 wherein the surface of the plate 202 is planar. The corrugations 206 thus expose an increased heat-conducting surface in the area 208 between the inlet area 210 and the outlet area 212.

Figure 9:
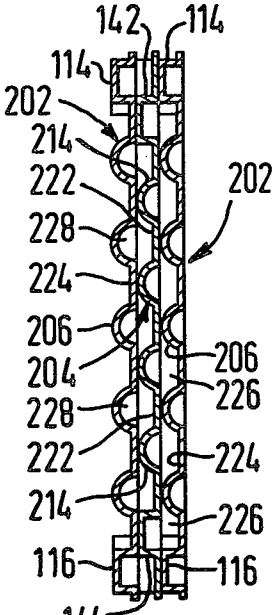
FIG. 9 is a cross-sectional view of the stacked plates taken along the line 9—9 of FIG. 8.
Figure 8:
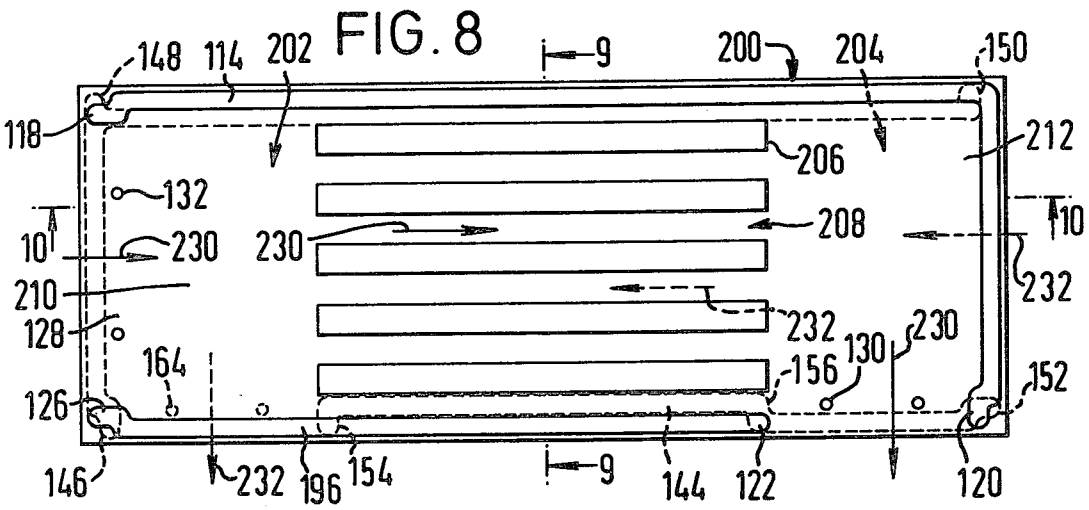
FIG. 8 is a top plan view of stacked plates as shown in FIG. 7.
Figure 10:
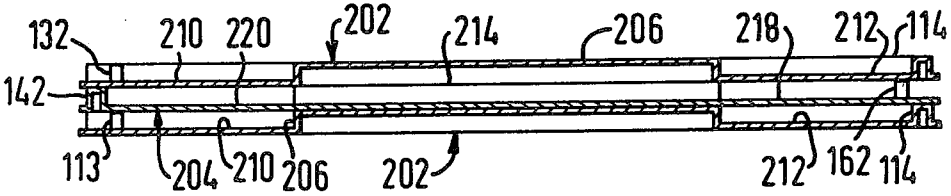
FIG. 10 is a cross-sectional view of the stacked plates taken along line 10—10 of FIG. 8.

The second plate 204 has parallel corrugations 214 running longitudinally between the corrugations 142 and 144. The corrugations 214 are like the corrugations 206 except that the corrugations 214 are laterally offset from the corrugations 206 as shown in FIG. 9. The area formed with corrugations 214 is mainly a heat exchange area 216. The planar end areas of the plate 204 form an air inlet area 218 and an air outlet area 220, with corrugations 214 forming an area 216 of increased exposure for heat exchange.

The first and second plates 202 and 204 are stacked alternately, thus constructing core 200 like that shown in FIG. 1.

When the second plate 204 is stacked on the first plate 202, the backs of the bottom spaces 222 between the corrugations 214 of the plate 204 are in contact with the ridges of the corrugations 206. Moreover, the backs of the bottom spaces 224 between the corrugations 206 are in contact with the ridges of the corrugations 214. Accordingly, there is provided a primary air passageway 226 between the bottom spaces 224, the ridges of the corrugations 206 and the undersurface of the ridges of the corrugations 214. There is also provided a secondary air passageway 228, between the bottom spaces 222, the ridges of the corrugations 214 and the undersurface of the ridges of corrugations 206.

As to the embodiment of FIGS. 7–10, the primary air 230 flows into the inlet 128, through the inlet area 210, the primary air passageways 226, the air outlet area 212, and out from the outlet 124. The secondary air 232 flows into the inlet 158, through the inlet area 218, the secondary air passageways 228, the outlet area 220, and out from the outlet 160.

The passage directions of the primary air 230 and the secondary air 232 are opposite to each other through the passageways 226 and 228. The heat exchange between the primary air 230 and the secondary air 232 is done through conduction of the plates 202 and 204.

The parallel corrugations 206 and 214 act not only as spacers between the plates, but also act to channel the air flow and to increase the surface areas of conductivity of the plates. As the corrugations 206 and 214 are formed in the step when the plates 202 and 204 are made, the manufacturing steps of the core 200 and the number of elements are less than the prior art heat exchanger device which is composed of plates and spacers. Moreover, the corrugations 206 and 214 contribute to increase the heat-exchanging function. The efficiency of the heat exchanger, therefore, becomes higher.

Figure 11:
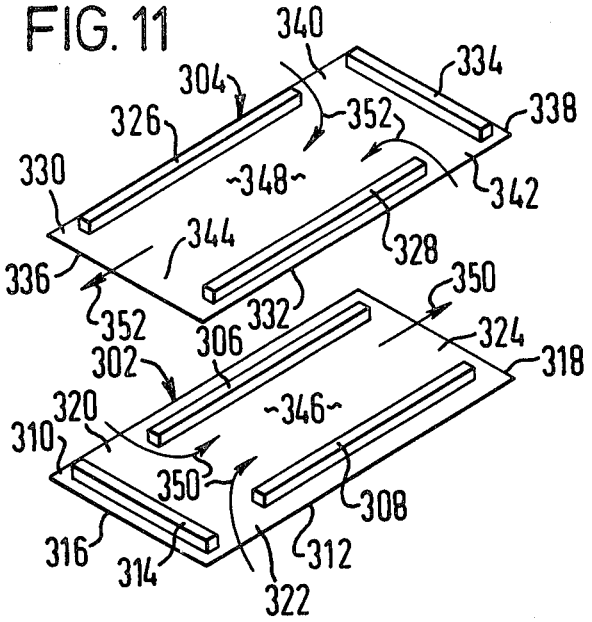
FIG. 11 is an exploded, perspective view of a third embodiment of the plates of the core according to this invention.
Figure 12:
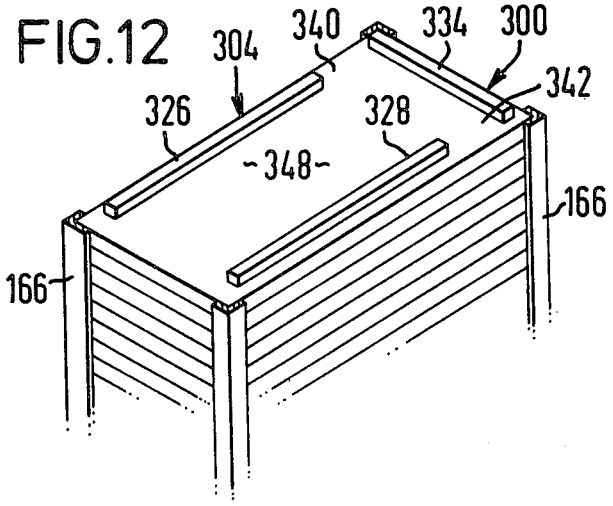
FIG. 12 is a perspective view of a core having stacked plates as shown in FIG. 11.

FIGS. 11 and 12 show a third embodiment of the plates of the core according to this invention.

A core 300, like the core 100, is composed of stacked plates which are first plates 302 and second plates 304. A pair of parallel corrugations 306 and 308 is formed with the first plate 302, when fabricated. The corrugations 306 and 308 run along a pair of long sides 310 and 312. A single corrugation 314 also runs along one of short sides 316 or 318. The corrugations 306 and 308 are spaced away from the corrugation 314 but, if extended, would be perpendicular thereto. There are thereby provided air inlets 320 and 322 between the corrugation 314 and the adjacent ends of the corrugations 306 and 308, air outlet 324 being between the other ends of the corrugations 306 and 308.

The second plate 304 also has a pair of parallel corrugations 326 and 328 along a pair of long sides 330 and 332. A single corrugation 334 runs along one of short sides 336 or 338 on the end opposite to the corrugation 314. The corrugations 326 and 328, if extended, would also be perpendicular to the corrugation 334. There are, thus, provided air inlets 340 and 342 between the corrugation 334 and the adjacent ends of corrugations 326 and 328, air outlet 344 being between the other ends of the corrugations 326 and 328.

In this embodiment also, the corrugations have ridges on one side of the plates and grooves on the opposite side of the plates.

A second plate 304 is stacked on a first plate 302. The back surface of the blate 304 is in contact with the ridges of the corrugations 306, 308 and 314 of the plate 302, air-tightly pressed together, as described regarding FIG. 1. Similarly, the back surface of the plate 302 is in contact with the ridges of the corrugations 326, 328 and 334 of another plate 304.

Consequently, there are provided a primary air passageway 346 on the first plae 302 and a seond air passageway 348 on the second plate 304 between successive pairs of plates. The primary air 350 flows into the inlets 320 and 322, through the first air passageway 346, and out from the outlet 324. The secondary air 352 flows into the inlets 340 and 342, through the secondary air passageway 348, and out from the outlet 344.

In this third embodiment, the distance between the corrugations 306 and 308 of the first plate 302 is smaller than that between the corrugations 326 and 328 of the second plate 304. For this reason the ridges of the corrugations 306 and 308 of the plate 302 do not fit into the grooves of the corrugations 326 and 328 of the plate 304. The successive plates are, therefore, separated and supported by the corrugations.

FIGS. 13 and 14 show a fourth embodiment of the plates of the core according to this invention.

A core 400 is composed of first plates 402 and second plates 404 and is similar to the core 300. The first plates 402 and the second plates 404 are stacked alternately and are similar to the plates 302 and 304 (FIG. 11). However, the corrugations 406 and 408 of plates 402 and 404 are different from the corrugations 308 and 326 of the plates 302 and 304.

The corrugation 406 of the first plate 402 has a middle portion 410, an end portion 414 and a portion 412 offset from the end portion 414. The corrugation 408 of the plate 404 has a middle portion 416, an end portion 420 and a portion 418 offset from the portion 420. The end portions 414, 420 adjoin long sides of the rectangular plates and the portions 412, 418 are offset inwardly at the middle portions 410, 416. Preferably the offset portions 412, 418 are longer than the end portions 414, 420. Whereas, in FIG. 11 the corrugations 326 and 328 adjoin the long sides of plate 304 and the corrugations 306 and 308 are offset inwardly, from the long sides of the plate 302, all the corrugations of plate 402 and 404 have at least a portion adjoining a side of the plates.

Referring particularly to FIG. 14, the ridge of the corrugation 422 does not fit into the groove of the offset portion 418 of the corrugation 408 when the second plate 404 is stacked on the first plate 402. Similarly, the ridge of the corrugation 424 does not fit in the groove of the offset portion 412 of the corrugation 406.

Preferably the corrugations of the plates 402 and 404 are dimensioned such that the inner ends of the corrugations 406 and 422 of plate 402 and corrugations 408 and 424 of plate 404 are perpendicular to, but spaced from the adjacent corrugations 314 and 334 at the short ends of the respective plates. Additionally, the middle portions 410 and 416 of the corrugations 406 and 408 are so positioned that the inner ends of the corrugations 424 and 422, respectively, immediately above and below are aligned with the relative middle portion. That is, the projections of the corrugations 424, 422, above or below, fit between the middle portions 410 and 416, and the corrugations 314 and 334, respectively.

FIGS. 15 to 21 show a fifth embodiment of the plate and a different arrangement of the core, according to this invention, wherein the air inlets and outlets are on opposite sides of the core.

Figure 15:
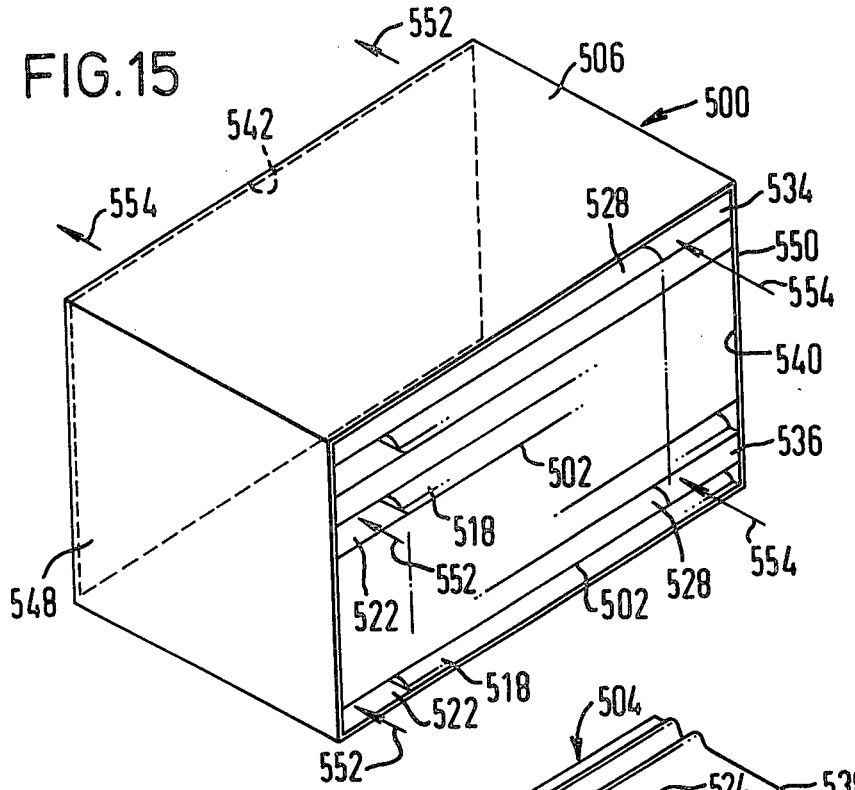
FIG. 15 is a perspective view of a core of the invention using a fifth embodiment of the plates.

Referring to FIG. 15, a core 500 is composed of first plates 502 and second plates 504. The first plates 502 and second plates 504 are stacked alternately and contained in a casing 506. The air inlets 510 and 536 are on one side of the casing 506 and the air outlets 512 and 532 (FIG. 16) are on the opposite side.

Figure 16:
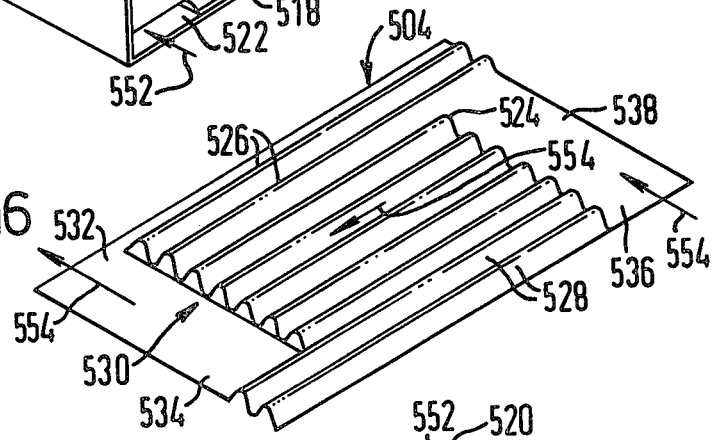
FIG. 16 is an exploded, perspective view of a pair of successive plates of the embodiment of FIG. 15.
Figure 16:
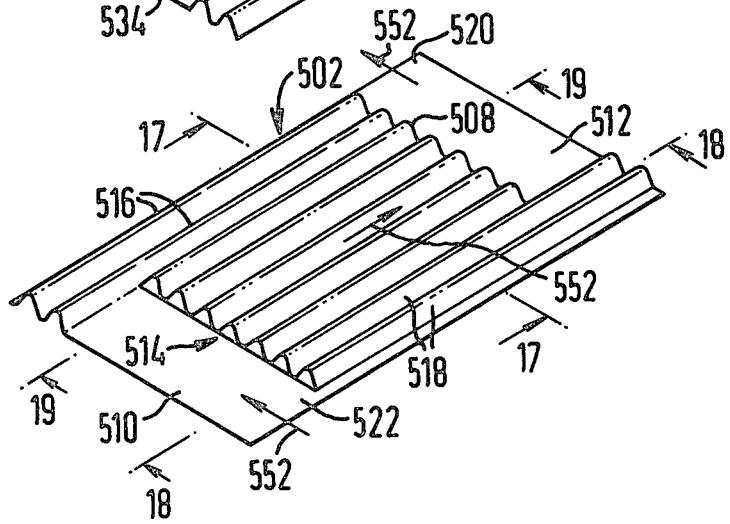

Referring to FIG. 16, the first plate 502 is formed with parallel corrugations 508 leaving an air inlet area 510 and an air outlet area 512 along the opposite short sides. The area formed with parallel corrugations 508 is the main heat exchange area 514. The cross section of each corrugation 508 is substantially sine-wave shaped (FIG. 17).

Figure 17:
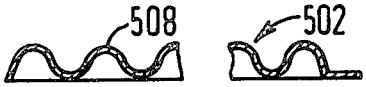
FIG. 17 is a cross-sectional view of one of the plates of the embodiment of FIG. 15 taken along the line 17—17 of FIG. 16.
Figure 18:
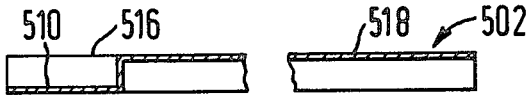
FIG. 18 is a cross-sectional view of the plate of FIG. 17 taken along the line 18—18 of FIG. 16.
Figure 19:
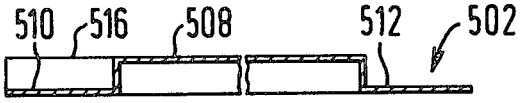
FIG. 19 is a cross-sectional view of the plate of FIG. 17 taken along the line 19—19 of FIG. 16.

Referring particularly to FIGS. 16, 17 and 19 long corrugations 516 and 518, parallel with the corrugations 508, are formed in the first plate 502 along the long sides. The corrugations 508 are centrally positioned on the plate 502 and the corrugations 516 and 518 extend beyond the corrugations 508 at each end, respectively, of the plates. The extending portions form the ends of the air inlet area 510 and outlet area 512, thus channeling the air flow. The other ends of the long corrugations 516 and 518 are aligned with corresponding ends of the corrugation 508. The air inlet area 510 of plate 502 runs across ends of the corrugations 518 and 508 and terminates at the extending end portions of the corrugations 516. On the other hand, the air outlet area 512 of plate 502 begins with the extended end portions of the corrugations 518, and runs across the other ends of the corrugations 508 and 516.

The second plate 504 has corrugations 524 and corrugations 526 and 528 are similar to the corrugations of the first plate 502, but reversed in their positioning so as to form the air inlet area 538 and air outlet area 534 at opposite ends and sides of the core 500 from the air inlet area 510, and outlet area 512 of plate 502. The area formed by parallel corrugations 524 is a main heat exchange area 530. An air outlet 532 is provided at the outlet area 534 and an air inlet 536 is provided at the air inlet area 538.

As shown in FIG. 15, the casing 506 has openings 540 and 542 on the sides for insertion or removal of the stacked plates 502 and 504.

Figure 20:
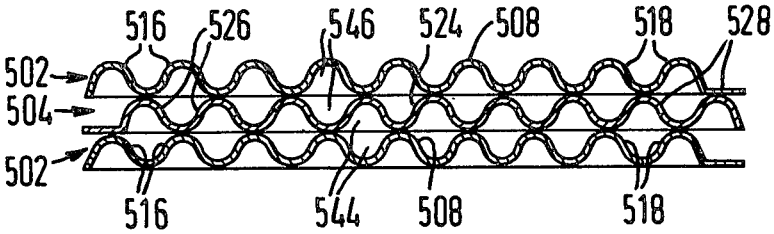
FIG. 20 is a cross-sectional view of three stacked plates according to the embodiment of FIG. 15 taken along a line corresponding to line 17—17 of FIG. 16.
Figure 21:
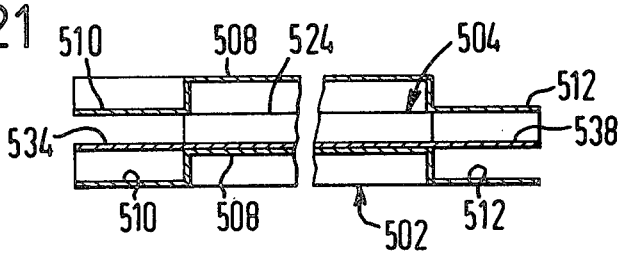
FIG. 21 is a cross-sectional view of three stacked plates according to the embodiment of FIG. 15 taken along a line corresponding to line 19—19 of FIG. 16.

As shown specifically in FIG. 20, the corrugations of plate 504 are offset with respect to the corrugations of plate 502. As a result, the bottom surfaces of the concave portions of the corrugations of the plates 502 are in contact with the top surfaces of the convex portions of the corrugations of the plate 504. Likewise the bottom surfaces of the concave portions of the corrugations of plate 504 are in contact with the top surfaces of the convex portions of the corrugations of the plate 502 immediately below. Accordingly, there are alternately provided primary air passageways 544 and secondary air passageways 546 between the first plates 502 and the second plates 504, through the tube-like openings formed by the cooperation of the open-ended corrugations 508 and 524. The air inlet areas 510 and the air outlet areas 512 across the short sides of the first plates 502 are closed by the side walls 548 and 550 of the casing 508. Likewise, the air outlet area 532 and the air inlet area 536 on the short sides of the second plate 504 are closed by the sidewalls of the casing.

Referring particularly to FIG. 15, the air inlets 522 and 536 are disposed in the opening 540 of the casing 508. The air outlets 520 and 532 (not shown in FIG. 15) are disposed in the opening 542 opposite to the opening 540.

Primary air 552 enters air inlet areas 510 through inlets 522 and secondary air 554 enters inlet areas 538 through inlets 536, as shown in FIGS. 15 and 16.

Figure 22:
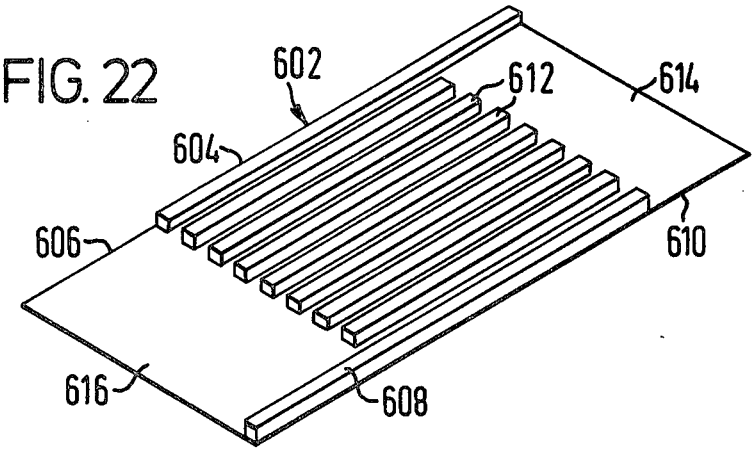
FIG. 22 is a perspective view of a sixth embodiment of the plates of the core according to this invention.

FIG. 22 shows a sixth embodiment of the plates, according to this invention, in which the cross sections of the corrugations are rectangular.

In this embodiment, a plate 602 has rectangular short corrugations 612 and long corrugations 604 and 608 which are analogous to corrugations 524, 526 and 528, respectively, of plate 504 in structure and function, forming an inlet area 614 and an outlet area 616. Only one long corrugation is shown along each side 606 and 610, but it is apparent that any desired number of long corrugations may be used on each long side with upper and lower plates (not shown) corresponding to plates 502, to form tube-like passages of rectangular cross section.

Figure 23:
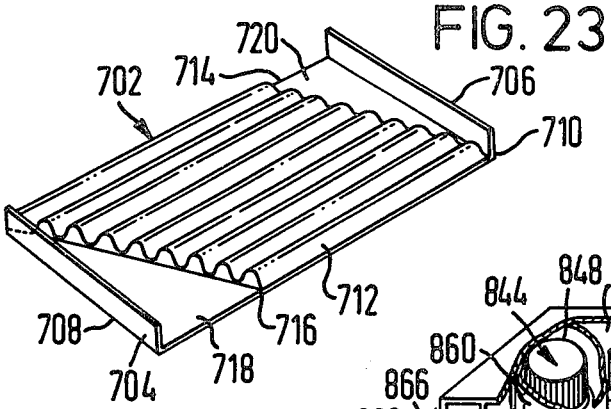
FIG. 23 is a perspective view of a seventh embodiment of the plates of the core according to this invention.

FIG. 23 illustrates a seventh embodiment of the plates, according to this invention.

In this embodiment, a plate 702 has closure walls 704 and 706 along short sides 708 and 710, respectively. Even length corrugations 712 are parallel to the long sides 714, 716 of plate 702 but shorter than the length of the long sides. The corrugations are offset with each other lengthwise by equal amounts. The amount of the longitudinal offset is adjusted to permit one end of the corrugation running along one long side 716 to abut the closure wall 706 and the other end of the corrugation running along the other long side 714 to abut the opposite closure wall 704.

By this arrangement, there is provided a triangular air inlet area 718 between the wall 704 and the ends of the corrugations 712 and a triangular air outlet area 720 between the wall 706 and the other ends of the corrugations 712. Air flows into the air inlet area 718 which is closed by the wall 704, through the corrugations 712, and out from the air outlet area 720 which is closed by the wall 706. The cross section of each corrugation 712 is substantially sine-wave shaped and the corrugations of successive plates are offset as shown in FIG. 20, with respect to the embodiment of FIG. 16.

In this embodiment, the side walls 548 and 550 as shown in FIG. 15 are not needed. It is apparent, of course, that the arrangement of the corrugations disclosed in FIG. 23 can be utilized on other embodiments of plates of the core of the invention, wherein the air inlets are on one side of the core and the air outlets on the other.

In the embodiment of FIGS. 15 to 23, corrugations have been used along long sides for closing the air inlets and outlets. However, if desired, these corrugations can be dispensed with and the air inlets and outlets closed by the walls of the casing.

Figure 24:
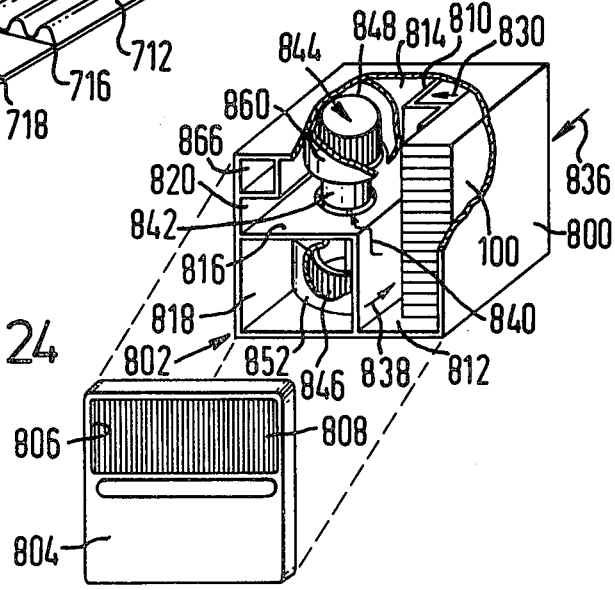
FIG. 24 is an exploded perspective view of certain portions of a housing partially broken away containing the core and a ventilation unit according to this invention.
Figure 25:
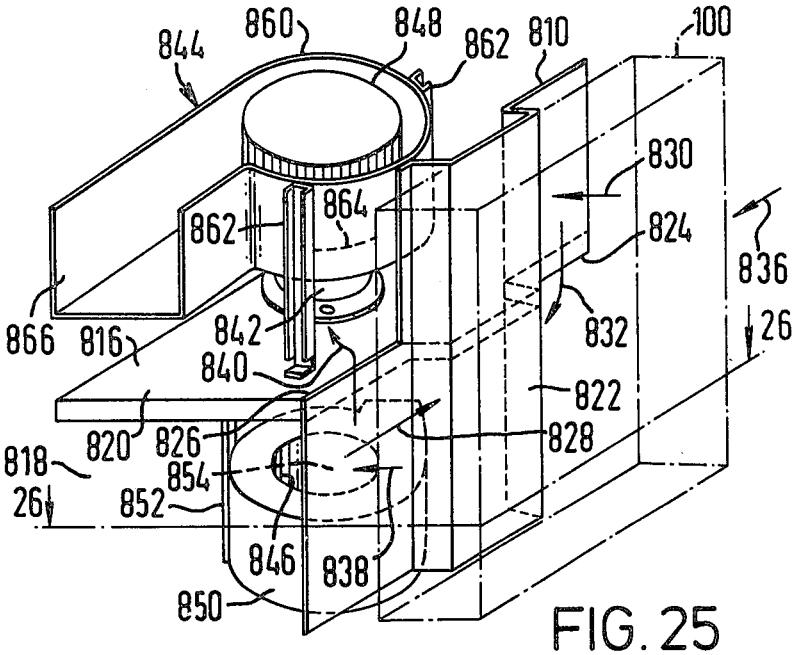
FIG. 25 is a perspective view of the ventilation unit shown in FIG. 24.
Figure 26:
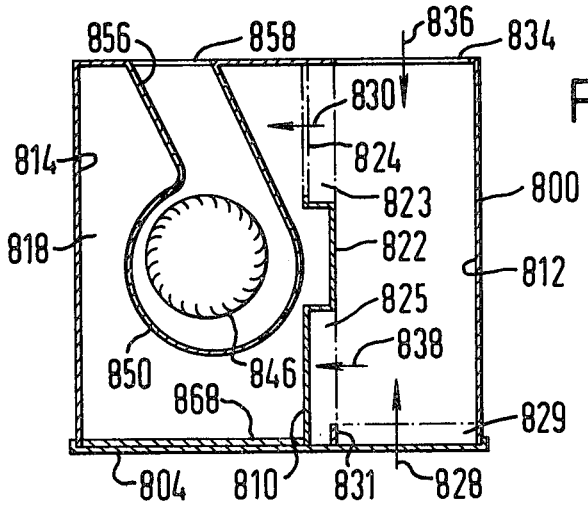
FIG. 26 is a cross-sectional view of the housing unit of FIG. 24 taken along the line 26—26 of FIG. 25.

FIGS. 24 to 26 show a heat exchanger device utilizing the core of the invention and a ventilation unit. A housing 800 contains the core and the ventilation unit. The housing 800 has a front opening 802 with a removable cover 804. The cover 804 provides air access to the interior of the housing through an opening 806 covered by a grill 808.

The interior of the housing 800 is divided by a partition member 810 into a first chamber 812 and a second chamber 814. The core 100, as shown in FIG. 1, for example, is contained in the first chamber 812. For purposes of the heat exchanger device as shown, the core has been reversed from the position shown in FIG. 1, so that the outlets are on the left side. The core can be inserted into, or removed from, the housing 800 through the front opening 802.

The second chamber 814 is divided by a separation member 816 into a first ventilation chamber 818 and a second ventilation chamber 820.

As shown, the first ventilation chamber 818 is at the bottom of chamber 814 and the second ventilation chamber 820 is at the top. The grill 808 is at the top of cover 804 and the cover 804 covers the opening 802 tightly so as to prevent access of outside air directly into the chamber 818 through the grill 808. In addition a portion of the grill is blocked off so as to prevent outside air from entering the second ventilation chamber 820, as will be explained hereinafter.

The partition member 810 has a projection portion 822 of rectangular cross section in contact with a side of the core 100 and forming channels 823 and 825 at the sides of the projection. The partition member 810 has openings 824 and 826 through which the first chamber 812 opens into the first ventilation chamber 818 through channel 823 and into the second ventilation chamber 820 through channel 825, respectively.

Accordingly, the primary air, shown as an arrow 828, is received through the grill 808 and flows through the front opening 802 into the primary inlets of the core 100. The core 100 is preferably shorter in length than the adjacent side of the housing 800 resulting in a space 829 between the core and the cover 804. The cover 804 is formed with an elongated stud 831 extending from top to bottom of the cover for contacting a corner of the core 100 and creating a channel including the area 829. Primary air entering the grill 808, therefore, flows along the end of the core and into each of the primary air inlets of the core.

The primary air shown as an arrow 830 flows out from the primary air outlets of the core 100 and flows through channel 823 into the first ventilation chamber 818 through the opening 824 in the partition member 810, as shown by arrow 832.

The rear of the housing 800 has an opening 834 aligned with the rear of the core 100. The secondary air, shown as an arrow 836, flows from the opening 834 into the secondary air inlets of core 100, through the core and out into channel 825, as indicated by arrow 838, and then into the second ventilation chamber 820 through the opening 826 of the partition member 810, as indicated by arrow 840.

A motor 842 contained in a ventilation unit 844 is mounted on the separation meber 816. The motor 842 has a shaft (not shown) which projects from both sides downwardly and upwardly from the separation member 816. The ends of the shaft of the motor 842 are connected to centrifugal type first and second fans 846 and 848.

A first casing 850 containing the first fan 846 is secured to the separation member 816 by at least one connection member 852 in the first ventilation chamber 818. The first casing 850 has an inflow port 854 which opens into the first ventilation chamber 818. The first casing 850 also has a discharge chute 856 which is connected to another opening 858 in the rear wall of the housing 800, and discharges air through the grill 808.

A second casing 860 containing the second fan 848 is secured to the separation member 816 by at least one connection member 862 in the second ventilation chamber 820. The second casing 860 has an inflow port 864 which opens into the second ventilation chamber 820. The second casing 860 has a discharge chute 866 which is connected to the front opening 802 of the housing 800, and discharges air through the grill 808.

The first ventilation chamber 818 is closed by the closure member 868 at the front side of the housing 800. Accordingly, the primary air 832 flowing out from the core 100 through channel 823 into the first ventilation chamber 818 is pulled from the inflow opening 854 into the first casing 852 by the fan 846. The primary air is then driven out through the discharge opening 858 to the outside of the housing.

The secondary air 836 flowing out from the core 100 into the second ventilation chamber 820 is pulled from the inflow opening 864 into the second casing 860 by the fan 848. The secondary air is then driven out through the discharge chute 866 to the outside of the housing 800. As indicated previously, the front of the second ventilation chamber 820 is blocked off by the housing 800 but leaves the chute 866 open through the grill 808.

The ventilation unit 844 is mounted parallel with the core 100 in the housing 800 and contains the motor 842 and the casings 850 and 860 with their fans 846 and 848. Accordingly, the volume of the housing 800 is minimized.

What is claimed is:

1. A core for a heat exchanger device comprising:

a stack of parallel plates each of said plates being formed from a single heat-conductive sheet, each plate having corrugations formed therein for channeling fluid between successive pairs of said plates, said corrugations of pairs of successive plates being relatively laterally offset from each other to provide separation and support of the plates by the contacts of the corrugations of each sheet with the plate immediately above or below, wherein said plates are rectangles and said corrugations of each plate include substantially like L-shaped corrugations along a pair of adjoining sides, a first leg of each L-shaped corrugation running along substantially the entire length of corresponding sides of successive plates and the second leg of the L-shaped corrugations being on opposite ends of the successive plates, and other corrugations running along corresponding sides opposite said first legs and leaving openings in said latter corresponding sides adjoining the ends of the second legs of the L-shaped corrugations, the fourth side of each plate being open for fluid flow.

2. The core of claim 1 wherein at least some of the ends of said corrugations have offset portions crossing corrugations on immediately successive plates above and below for maintaining the plates planar.

3. The core of claim 1 also including corrugations parallel to said first legs of the L-shaped corrugations for channeling fluid flow.

4. The core of claim 3 wherein said corrugations parallel to said first legs of the L-shaped corrugations are offset in successive plates to form passages for fluid flow.

5. The core of any one of claims 1, 2, 3 and 4 wherein both the first and second legs of alternate ones of said L-shaped corrugations are proximate the edge of the respective plates and the first legs of said L-shaped corrugations on plates between said alternate ones are offset inwardly from the respective edge of the relevant plates, and wherein the second legs of each of said L-shaped corrugations having a n inwardly offset first leg includes a portion extending beyond the inwardly offset first leg and terminating proximate an edge of the respective plates for maintaining the plates planar.

* * * * *